US005857450A

United States Patent [19]

Staerzl

[11] Patent Number: 5,857,450

[45] Date of Patent: Jan. 12, 1999

[54] LOW EMISSION TWO CYCLE ENGINE USING TWO SEGMENT PISTON

[75] Inventor: Richard E. Staerzl, Fond du Lac, Wis.

[73] Assignee: Brunswick Corporation, Lake Forest, Ill.

[21] Appl. No.: 881,212

[22] Filed: Jun. 24, 1997

[51] Int. Cl.[6] ..... F02B 33/14

[52] U.S. Cl. ..... 123/65 S; 123/73 PP; 123/58.6

[58] Field of Search ..... 123/73 PP, 65 S, 123/58.5, 58.6, 73 F, 47 A

[56] References Cited

U.S. PATENT DOCUMENTS

| | | | |
|---|---|---|---|
| 1,452,011 | 4/1923 | Watton | 123/73 F |
| 2,923,281 | 2/1960 | De Martin | 123/73 F |
| 3,996,903 | 12/1976 | Cseh | 123/65 S |
| 4,068,629 | 1/1978 | Hopper | 123/65 S |
| 4,138,971 | 2/1979 | Fujikawa | 123/58.6 |
| 4,169,434 | 10/1979 | Guenther | 123/47 A |
| 4,210,108 | 7/1980 | Hooper | 123/65 S |
| 4,522,163 | 6/1985 | Hooper | 123/73 F |
| 5,189,995 | 3/1993 | Hooper | 123/58.6 |
| 5,261,358 | 11/1993 | Rorke | 123/58.5 |

FOREIGN PATENT DOCUMENTS

| | | | |
|---|---|---|---|
| 1013920 | 8/1957 | Germany | 123/65 S |
| 1495556 | 12/1977 | United Kingdom | 123/65 S |

OTHER PUBLICATIONS

"Hooper's Hope" by Dave Searle and Doug Jackson, Oct. 1996, *Motorcycle Consumer News;* pp. 8–9.

*Primary Examiner*—David A. Okonsky
*Attorney, Agent, or Firm*—William D. Lanyi

[57] ABSTRACT

An internal combustion engine is provided with a top hat piston disposed in a cylinder having first and second portions of different diameters. The piston, with first and second portions of different diameters, is disposed within the cylinder and defines a compression chamber between a cylinder step and a piston step created by the different diameters. The compression chamber is connected in fluid communication with a fuel supply, such as a carburetor or fuel injector, which provides a fuel/air mixture into the compression chamber during the downstroke of the piston. When the piston is moving upward, it compresses the fuel/air mixture within the compression chamber until a second end of a transfer passage is moved into fluid communication with a transfer port formed in the wall of the first portion of the cylinder. This occurs after the exhaust port is closed by the piston and therefore significantly diminishes the chance for unburned fuel to pass directly out the exhaust port from the combustion chamber.

20 Claims, 9 Drawing Sheets

LOW EMISSION TWO CYCLE ENGINE USING TWO SEGMENT PISTON

BACKGROUND OF THE INVENTION

1. FIELD OF THE INVENTION

The present invention relates generally to internal combustion engines and, more particularly, to an engine which utilizes a piston having two diameters that define a step therebetween which is disposed in a cylinder with two diameters.

2. DESCRIPTION OF THE PRIOR ART

Many different types of internal combustion engines are well known to those skilled in the art. One particular type of engine is a two cycle engine. A common problem that occurs with two cycle engines is that, at low speeds, unburned fuel can be emitted in the exhaust stream. Naturally it is not desirable to exhaust hydrocarbons, in the form of unburned fuel, into the atmosphere for ecological reasons.

The emission of fuel in the exhaust stream can be caused at low speeds by the fact that a fuel/air mixture enters the combustion chamber prior to the exhaust port being closed. Under certain circumstances, the fuel/air mixture can propagate through the combustion chamber and pass out the exhaust port prior to the ignition of the fuel within the combustion chamber.

In certain applications of two cycle engines, fuel injection is used to alleviate this problem. Fuel injectors can be disposed in fluid communication with the combustion chamber, either through a cylinder wall or through the end of the cylinder. One of the goals of these types of solutions is to provide a stratified charge of fuel at one portion of the combustion chamber a distance away from the exhaust port.

U.S. Pat. No. 4,068,629, which issued to Hooper on Jan. 17, 1978, discloses a stepped piston two stroke engine which includes at least two cylinders. Each cylinder has a working part of smaller diameter and a pumping part of larger diameter. The main inlet ports are arranged symmetrically about and spaced from a plane which contains a longitudinal access of the cylinder and which passes through the center of the exhaust port. The auxiliary inlet port is provided in the cylinder wall opposite the exhaust port. Main and auxiliary transfer passages are provided for the main and auxiliary inlet ports. The auxiliary inlet ports and auxiliary transfer passages lie wholly on one side of an axial plane which contains the axes of the two cylinders of the set. The exhaust ports of both cylinders on the other side of this plane. Only air may be supplied to the working part of each cylinder through the main inlet ports, while fuel is injected into the air passing through the auxiliary transfer passages so that a mixture of fuel and air enters the working parts of the cylinders through the auxiliary inlet ports. By this means charge stratification in the working parts of the cylinders can be achieved.

U.S. Pat. No. 4,138,971, which issued to Fujikawa et al on Feb. 13, 1939, describes a crank chamber precompression type two-cycle internal combustion engine which includes a pair of stepped cylinders and a pair of stepped pistons slidably disposed in the cylinders. These define annular spaces of variable volume in the cylinders. The pistons are interconnected to each other with 180 degrees phase difference. An air-fuel mixture is introduced into the annular space in one cylinder and forced into the crank chamber of the other cylinder during the upward stroke of the associated piston, so that an additional charge is provided.

U.S. Pat. No. 4,169,434, which issued to Guenther on Oct. 2, 1979, describes an internal combustion engine with a stepped piston supercharger. A reciprocating piston four cycle internal combustion engine utilizes a stepped piston. The stepped portion of the piston works in an enlarged bore in the block of the engine, and serves as a compressor to provide a supercharged fuel-air mixture into the combustion chamber. The compressor delivers two compression strokes per engine cycle. The compressed fuel-air mixture travels from the compressor via a bypass manifold which also serves as an accumulator. It then passes to the main cylinder via an intake valve. The fuel-air mixture is admitted to the compressor cylinder through the crankcase and valved passages through the stepped portion of the piston.

U.S. Pat. No. 4,210,108, which issued to Hooper on Jul. 1, 1980, discloses a stepped piston two stroke engine which has a stepped piston in which the cylinder casting has a bore of greater diameter to form a pumping part, a bore of lesser diameter to form a working part, exhaust port means in the working part and opposed transfer part means on opposite sides of the working part disposed symmetrically about a plane passing through the longitudinal axis of the cylinder. The plane also passes through the center of the exhaust port means. The transfer port means is of a form to be produced in the casting process by non-separate cores introduced lineally towards the plane.

U.S. Pat. No. 4,522,163, which issued to Hooper on Jun. 11, 1985, describes a stepped piston and a stepped piston engine. The engine has one or more cylinders and each cylinder contains a stepped piston having a pumping part of larger diameter and a working part of smaller diameter. The working part of the piston is slidably in and associated with a working part of the cylinder in which a combustion of a fuel-air mixture takes place. The pumping part of the piston is slidably in and associated with a pumping part of the cylinder. The piston has a body with an interial hollow opening to the outside toward the lower end of the piston. The body comprises a smaller diameter working part which extends from the top of the piston to a step and a larger diameter pumping part extending from the step to a lower end of the piston. At least one piston ring groove is formed in an outer surface of the smaller diameter part and at least one piston ring groove is formed in the outer surface of the large diameter part.

U.S. Pat. No. 5,189,995, which issued to Hooper on Mar. 2, 1983, describes a stepped piston engine that comprises first, second and third step cylinders with each cylinder having a large diameter pumping part and a small diameter working part. A piston is slidable in the cylinder and each piston is coupled to an output shaft of the engine. A first transfer passage transfers the precompressed charge from the large diameter pumping part of the first cylinder to the smaller diameter pumping part of the second cylinder. A second transfer passage transfers precompressed charge from the large pumping part of the second cylinder to the smaller diameter working part of the third cylinder. A third transfer passage transfers precompressed charge from the large diameter pumping part of the third cylinder to the smaller diameter working part of the first cylinder.

One of the many designs for pistons for internal combustion engines is described in an article titled "Hooper's Hope" which was written by Dave Searle and Doug Jackson in the Oct., 1996 issue of Motorcycle Consumer News. This article describes a piston which comprises two portions, one with a diameter that is less than the other. The configuration, because of its physical appearance, is sometimes referred to as "Top Hat" piston. The configuration described in this article utilizes two cylinders, as a cooperative pair, with one cylinder providing an air flow into the combustion chamber of the other cylinder. The design described in this reference requires cylinders to be arranged in such a way that they are able to cooperate with each other in an associated pair.

It would therefore be significantly beneficial if a two cycle engine could be developed which is able to provide a stratified charge into the combustion chamber of the cylinder without the need for complex fuel injection systems.

SUMMARY OF THE INVENTION

In a preferred embodiment of the present invention, an internal combustion engine is provided with an engine block having a cylinder formed therein. The cylinder has a first portion and a second portion. The first portion has a first diameter which is smaller than a second diameter of the second portion. The first and second diameters of the first and second portions of the cylinder define a cylinder step in a wall of the cylinder.

The preferred embodiment of the present invention also comprises a piston having a first portion and a second portion. The first portion has a first diameter which is smaller than a second diameter of the second portion of the piston. The first and second diameters of the first and second portions of the piston define a piston step in an outer surface of the piston. The piston is disposed within the cylinder.

A compression chamber space is defined by the cylinder and piston steps and, in addition, by an outer surface of the first portion of the piston and an inner surface of the second portion of the cylinder. A combustion chamber is defined by an end of the first portion of the cylinder, an end of the first portion of the piston and a wall of the first portion of the cylinder.

A first conduit is connected in fluid communication with the compression chamber to provide a flow of fuel and air into the compression chamber. A transfer passage is formed in the piston. The transfer passage has a first end and a second end. The first end of the transfer passage is disposed in fluid communication with the compression chamber. The second end of the transfer passage is disposed in fluid communication with an opening in an outer cylindrical surface of the first portion of the piston. A transfer port is formed in a wall of the first portion of the cylinder. The transfer port provides fluid communication between the transfer passage and the combustion chamber when the opening of the second end of the transfer passage is aligned with the transfer port.

The first and second portions of the cylinder and the first and second portions of the piston can be disposed in coaxial relation with each other along a common central axis. A first fuel supply device is connected in fluid communication with the first conduit for providing a primary flow of fuel and air into the combustion chamber between the cylinder and piston steps. The first fuel supply device can be a carburetor or a fuel injector.

A particularly preferred embodiment of the present invention further comprises a crankcase in which a crankshaft is disposed. As known to those skill in the art, connecting rods are connected between the crankshaft and the piston in an internal combustion engine. Rotation of the crankshaft is caused by the reciprocating motion of the piston. In one preferred embodiment of the present invention, a second conduit is connected in fluid communication between the crankcase and the first portion of the cylinder. This second conduit typically carries a flow of air from the crankcase into the combustion chamber. In certain particularly preferred embodiments of the present invention, a second fuel supply device is disposed in fluid communication with the crankcase for providing a secondary flow of fuel into the crankcase and into the compression chamber through the second conduit. The second fuel supply device can be a carburetor or a fuel injector.

An exhaust conduit is connected in fluid communication with the first portion of the cylinder. In a typical application of the present invention, the exhaust conduit is connected in fluid communication with the first portion of the cylinder at a location between the end of the first portion of the cylinder and a location where the second conduit is connected in fluid communication with the first portion of a cylinder to provide a flow of air or a fuel/air mixture from the crankcase.

In certain embodiments of the present invention, an igniter is disposed at least partially within the combustion chamber. This igniter can be a sparkplug which is provided with power at a preselected time during the movement of the piston when it is at top dead center or just prior to reaching the top dead center position.

BRIEF DESCRIPTION OF THE DRAWINGS

The present invention will be more fully and completely understood from the reading of the description of the preferred embodiment in conjunction with the drawings, in which.

DESCRIPTION OF THE PREFERRED EMBODIMENT

Figure 1A:
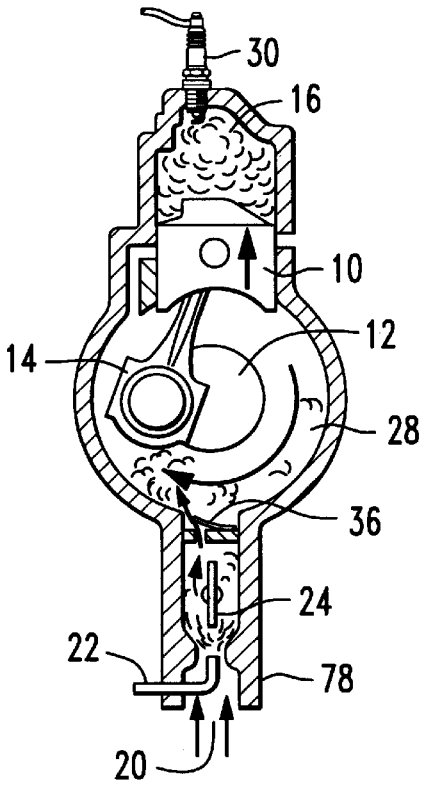
FIG. 1A PRIOR ART
FIGS. 1A–1D show various portions of the two cycle process.

Throughout the description of the preferred embodiment, like components will be identified by like reference numerals.

FIGS. 1A–1D show the four basic stages of a two cycle engine. In FIG. 1A, the piston 10 is moving upward as the crankshaft 12 causes the connecting rod 14 to push it in that direction. Although not shown in FIG. 1A, it should be understood that typical internal combustion engines utilize a plurality of pistons and the pistons are sequenced so that some are rising, as shown in FIG. 1A, as others are moving downward and providing rotational movement to the crankshaft 12. In FIG. 1A, a fuel/air mixture in the combustion chamber 16 is being compressed by the upward movement of the piston 10. The fuel/air mixture results from the flow of air into an intake 78 and a supply of fuel through a nozzle 22, past a throttle valve 24 and into the crankcase 28. As will be described below, the fuel/air mixture within the crankcase 28 is ported into the combustion chamber during another portion of the process.

Figure 1B:
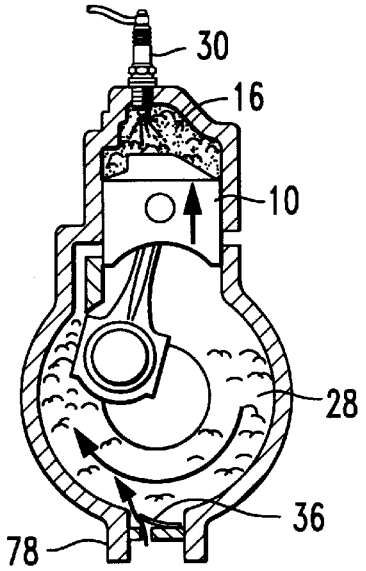
FIG. 1B PRIOR ART

In FIG. 1B, a spark from the sparkplug 30 ignites the fuel/air mixture within the combustion chamber 16 and causes it to begin expanding. In FIGS. 1A and 1B, the reed valve 36 remains open to allow a flow of air and fuel into the crankcase 28.

Figure 1C:
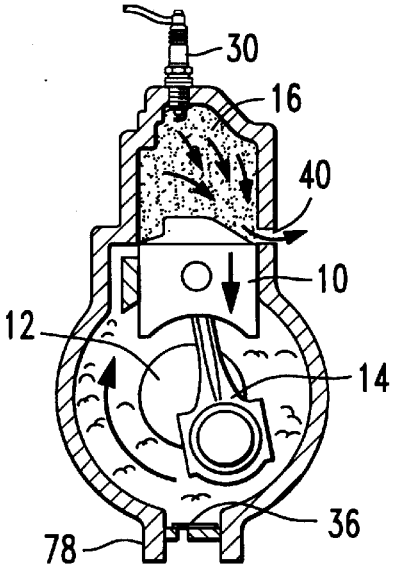
FIG. 1C PRIOR ART

In FIG. 1C, the rapidly expanding fuel/air mixture that has been ignited by the sparkplug 30 within the combustion chamber 16 forces the piston 10 downward. This downward movement of the piston causes it to move past an exhaust port 40 and open the combustion chamber 16 to the atmosphere. The expanding gases within the combustion chamber 16 pass through the exhaust port 40. The downward force provided by the rapid expansion of the fuel/air mixture after being ignited by the sparkplug 30 causes the piston 10 to move downward and rotate the crankshaft 12.

It should be understood that the downward movement of the piston 10 within the cylinder reduces the volume of the crankcase 28. This reduction in volume increases the pressure. It should also be noted that when the piston 10 is moving downward, this increased pressure causes the reed valve 36 to close.

After passing the exhaust port 40, the upper edge of the piston 10 passes an inlet port 44. When this occurs, the higher pressure fuel/air mixture within the crankcase 28 flows from the crankcase through the cylinder inlet port 44 and into the combustion chamber 16. The flow of the fuel/air mixture into the combustion chamber 16 also assists in forcing the exhaust gases out of the exhaust port 40.

Figure 1D:
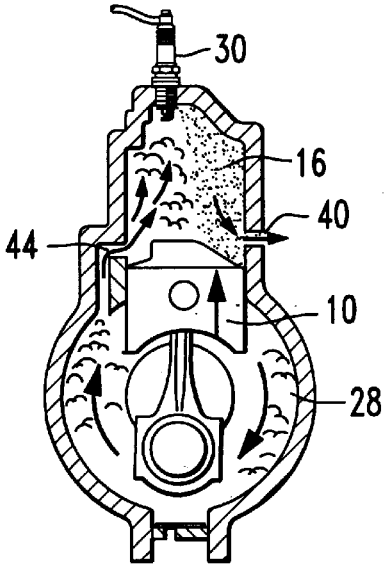
FIG. 1D PRIOR ART

As can be seen in FIG. 1D, the flow of fuel through the inlet port 44 occurs while the exhaust port 40 is opened. This permits the possibility of unburned fuel passing directly from the cylinder inlet port 44 to the exhaust port 40 prior to the ignition of the mixture in the combustion chamber 16. This passage of unburned fuel through the exhaust port 40 emits hydrocarbons into the air and is highly undesirable. The emission of fuel in the exhaust stream is most likely to occur during times when the internal combustion engine is running at idle speed.

Figure 2:
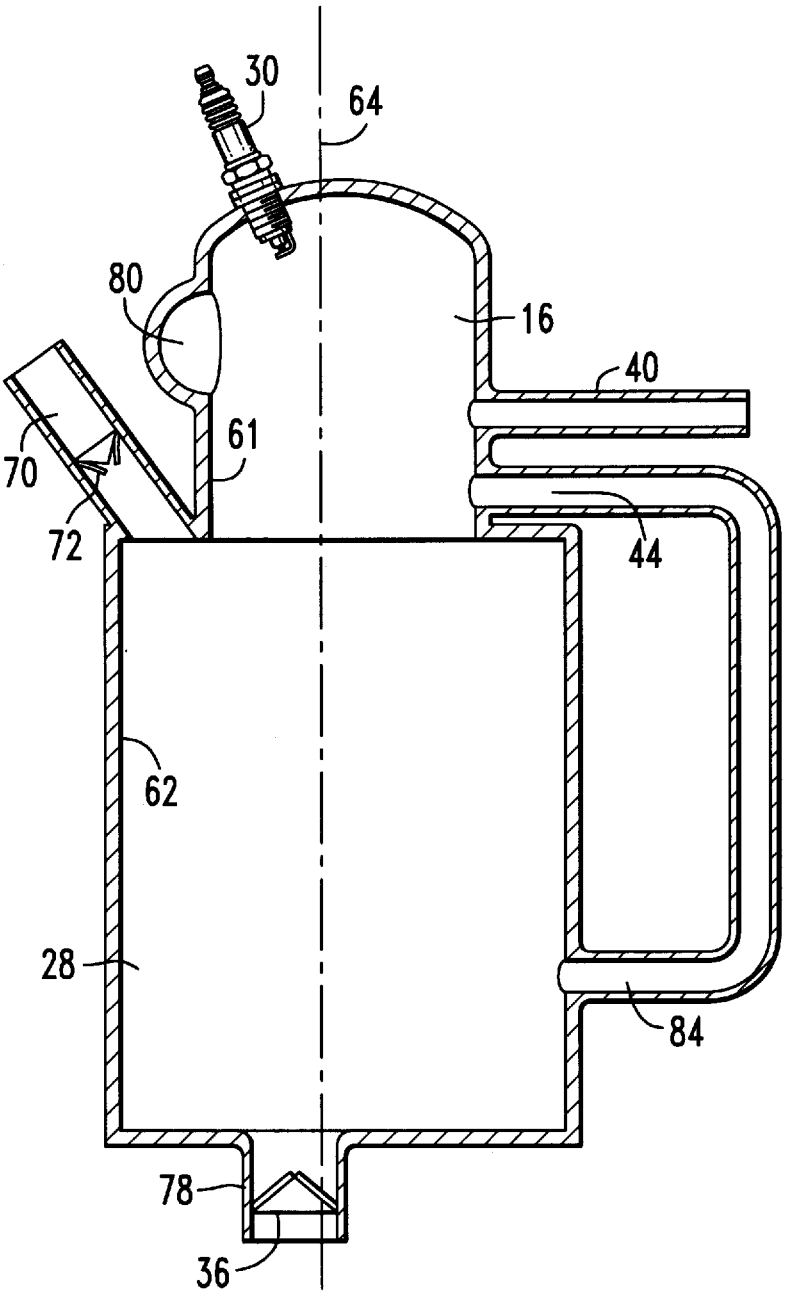
FIG. 2 is a highly simplified schematic illustration of a cylinder arrangement in accordance with the present invention.

FIG. 2 illustrates, in a highly simplified schematic figure, the components of an internal combustion engine made in accordance with the concept of the present invention. The cylinder, which is typically formed in an engine block, comprises a first portion 61 and a second portion 62. The first and second portions of the cylinder are generally cylindrical in shape and are coaxial with each other along axis 64. The difference in the diameters between the first and second portions of the cylinder defines a cylinder step 68. At the top of the first portion 61, a sparkplug 30 is disposed for igniting a fuel/air mixture within the combustion chamber 16. The exhaust port 40 is shown being connected in fluid communication with the combustion chamber 16. In addition, the inlet port 44 is shown connected in fluid communication with the crankcase 28. A first conduit 70 is provided to allow a fuel/air mixture to be transmitted into an area of the cylinder near the cylinder step 68. More specifically, as will be described in greater detail below, the fuel/air mixture is provided through the first conduit 70 into a compression chamber that is defined by the cylinder step 68 and a piston step that will be described below. A reed valve 72 provides a unidirectional flow of the fuel/air mixture through the first conduit 70 and into this compression chamber. Near the bottom of the second portion 62 of the cylinder, an intake conduit 78 allows air to pass into the crankcase 28. The reed valve 36 is generally similar to the reed valve described above in conjunction with FIGS. 1A–1D and serves a similar purpose. However, unlike the reed valve 36 described in conjunction with FIGS. 1A–1D, the reed valve 36 and the intake conduit 78 are not always used to pass a fuel/air mixture into the crankcase 28. In the present invention, certain embodiments do not cause fuel to be entrained within the air stream. Instead, only air flows through the intake conduit 78 in certain embodiments of the present invention.

With continued reference to FIG. 2, a transfer port 80 is also shown. The transfer port 80 is formed in the wall of the first portion 61 of the cylinder. Its function will be described in greater detail below. Also in FIG. 2, a second conduit 84 is provided to connect the crankcase 28 in fluid communication with the cylinder inlet port 44.

Figure 3A:
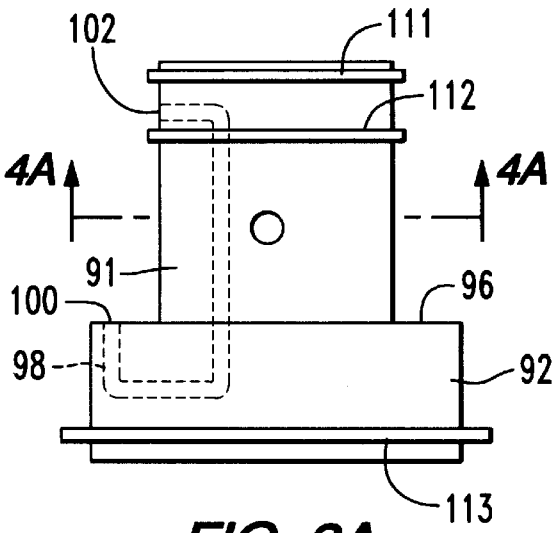
FIGS. 3A and 3B show two alternative embodiments of a piston made in accordance with the present invention.

FIG. 3A shows a piston made in accordance with one embodiment of the present invention. The piston has a first portion 91 and a second portion 92. The first and second portions of the piston have different diameters and these different diameters define a piston step 96 therebetween. A transfer passage 98 is a conduit that is formed within the body of the piston and has a first end 100 and a second end 102. The first end 100 is connected in fluid communication with a region proximate the piston step 96. As will be discussed in greater detail below, this places the transfer passage 98 in fluid communication with a compression chamber that is formed between the piston step 96 and a cylinder step 98.

With continued reference to FIG. 3A, three piston rings are illustrated. These piston rings, 111, 112 and 113, assist in providing a seal between the piston and the inner cylindrical walls of the cylinder. Although used in most internal combustion engines, these piston rings are not required in all embodiments of the present invention. However, in a preferred embodiment of the present invention, piston rings are used for these known purposes and the second end 102 and the transfer passage 98 is disposed between the two upper piston rings, 111 and 112.

Figure 3B:
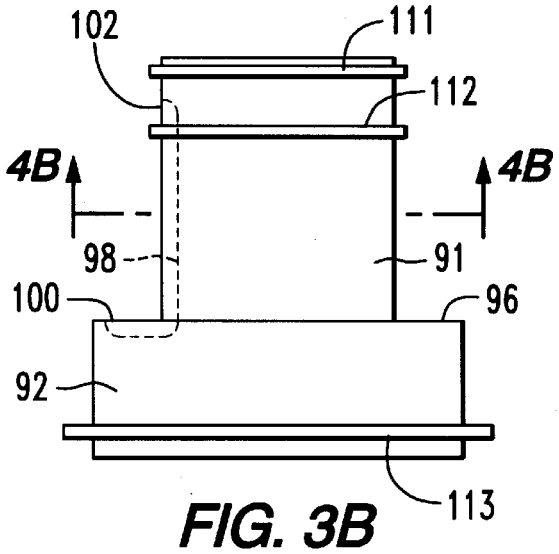

FIG. 3B shows an alternative embodiment of the piston. In FIG. 3B, the transfer passage 98 is not formed as a hole that is completely surrounded by the body of the piston. Instead, it is a groove formed in the piston step 96 and the outer surface of the first portion 91 of the piston. The transfer passage 98 is surrounded by the piston in which it is formed and the cylindrical wall of the first portion 61 of the cylinder. In the manner described above, its first end 100 and second end 102 operate to connect the compression chamber above the piston step 96 with the second end 102.

Figure 4A:
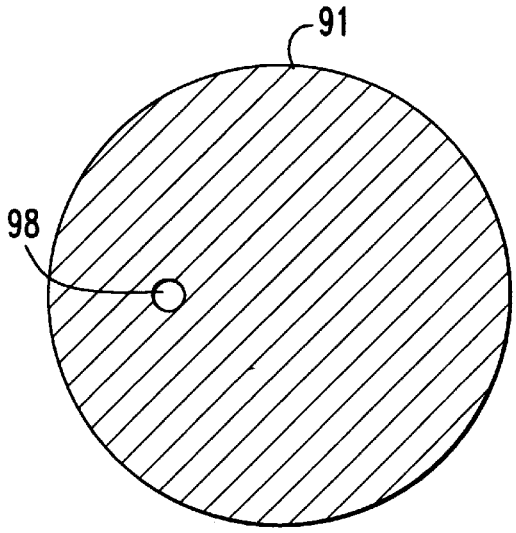
FIGS. 4A and 4B are section views of FIGS. 3A and 3B, respectively.
Figure 4B:
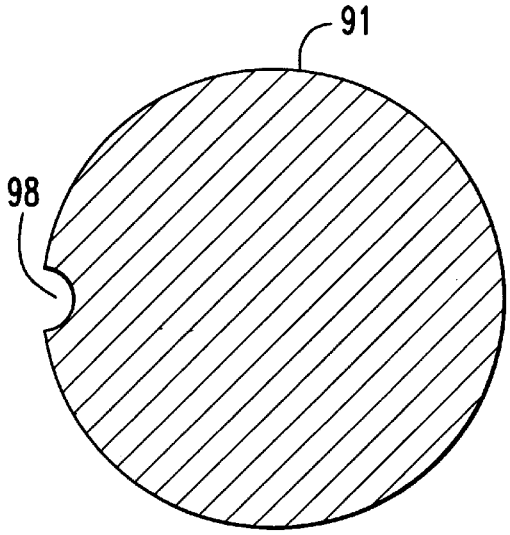

FIGS. 4A and 4B are section views of FIGS. 3A and 3B, respectively. In FIG. 4A, the first portion 91 of the piston is shown with the transfer passage 98 formed, as a generally circular hole, along a portion of the piston body. This provides the required conduit to transmit a fuel/air mixture from the first end 100 of the transfer passage 98 to its second end 102 as described above.

FIG. 4B shows a section view of the alternative embodiment illustrated in FIG. 3B. The first portion 91 of the piston has a groove formed in its outer surface to serve as the transfer passage. When the piston is disposed within the cylinder, the cylindrical wall of the cylinder cooperates with the groove in the outer surface of the piston to define a fluid passage through which the fuel and air mixture can move from the first end 100 to the second end 102 of the transfer passage 98.

Figure 5B:
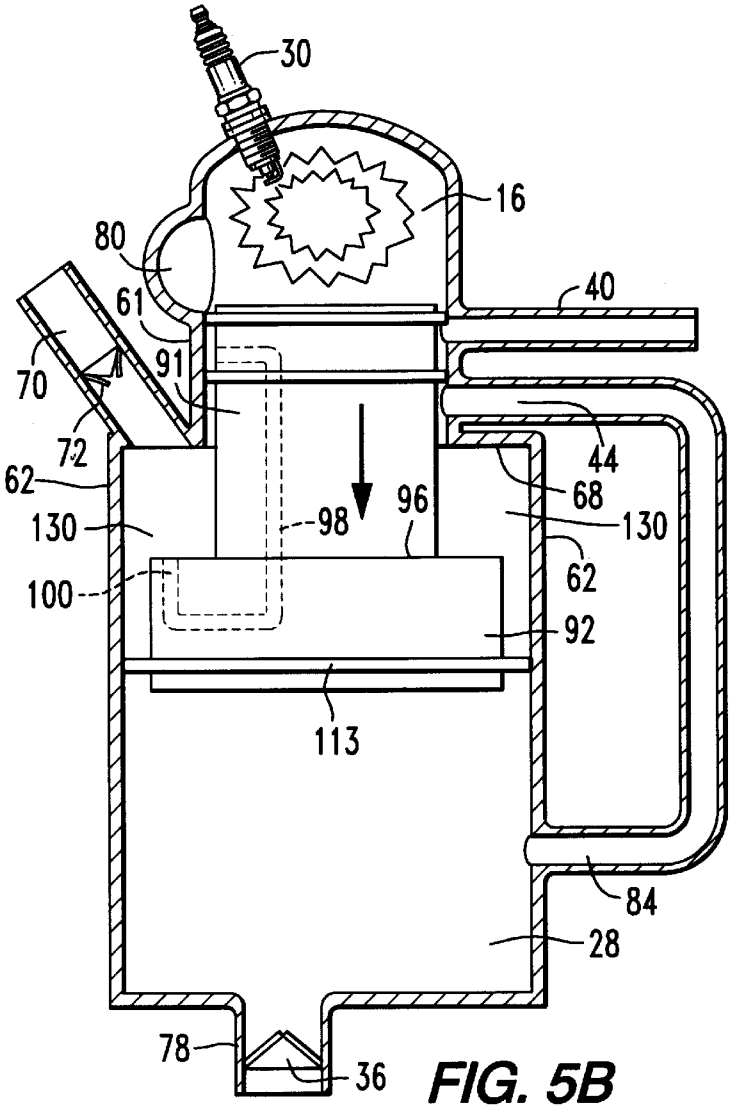
FIGS. 5A–5H show various stages during the two cycle process for an engine made in accordance with the present invention.
Figure 5A:
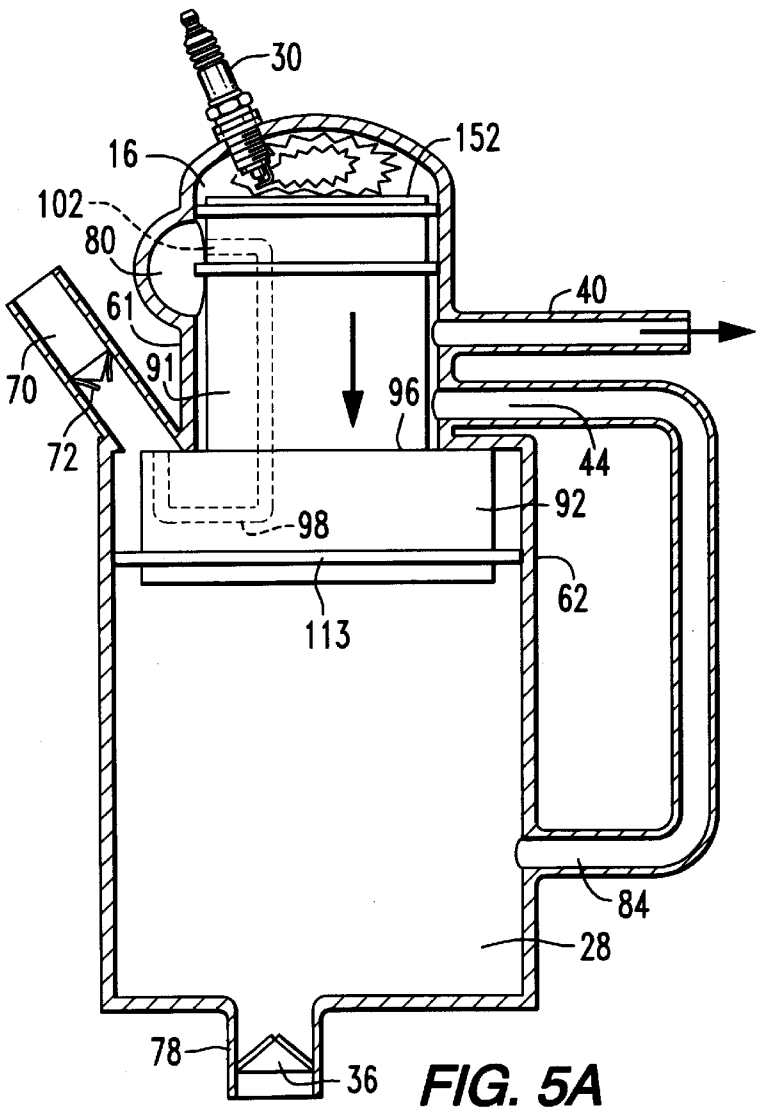

FIG. 5A shows the piston of FIG. 3A assembled in association with the cylinder of FIG. 2. As can be seen, the first portion 91 of the piston is disposed in the first portion 61 of the cylinder and the second portion 92 of the piston is disposed in the second portion 62 of the cylinder. In the particularly preferred embodiment illustrated in FIG. 5A, the first and second portions of the pistons and the first and second portions of the cylinder are arranged in coaxial association with each other about a common axis, such as axis 64 shown in FIG. 2. The sequence of operations performed by the piston and cylinder will be described below in conjunction with FIGS. 5A–5H.

In FIG. 5A, the sparkplug 30 has caused the fuel/air mixture in the combustion chamber 60 to ignite. The rapidly expanding gas within the combustion chamber 16 begins to cause the piston to move downward as represented by the arrow. The downward movement of the piston increases the pressure within the crankcase 28 because of the reducing volume within the crankcase. Reed valve 36 is closed, thereby preventing flow of air out of the crankcase 28 through the intake passage 78. Reed valve 72 begins to open in response to the downward movement of the piston and a fuel/air mixture is allowed to pass through the first conduit 70 into the region above the piston step 96.

FIG. 5B shows the piston at a time subsequent to that shown in FIG. 5A. The expanding gas within the combustion chamber 16 continues to force the piston downward. A compression chamber 130 is more clearly shown in FIG. 5B. This compression chamber 130 is defined by the cylinder step 68, the piston step 96 and the cylindrical wall of the second portion 62 of the cylinder. The continued downward movement of the piston maintains the reed valve 36 in a closed position and the reed valve 72 in a opened position. This allows a fuel/air mixture to flow through the first conduit 70 into the compression chamber 130. It should be noted that the exhaust port 40 and the cylinder inlet port 44 are still closed by the presence of a piston in overlapping association therewith. Therefore, no flow is passing through the exhaust port 44 from the combustion chamber 16 and no flow is passing from the crankcase 28 through the second conduit 84 toward the cylinder inlet port 44. However, the compression chamber 130 is expanding and filling with a fuel/air mixture provided through the first conduit 70.

Figure 5D:
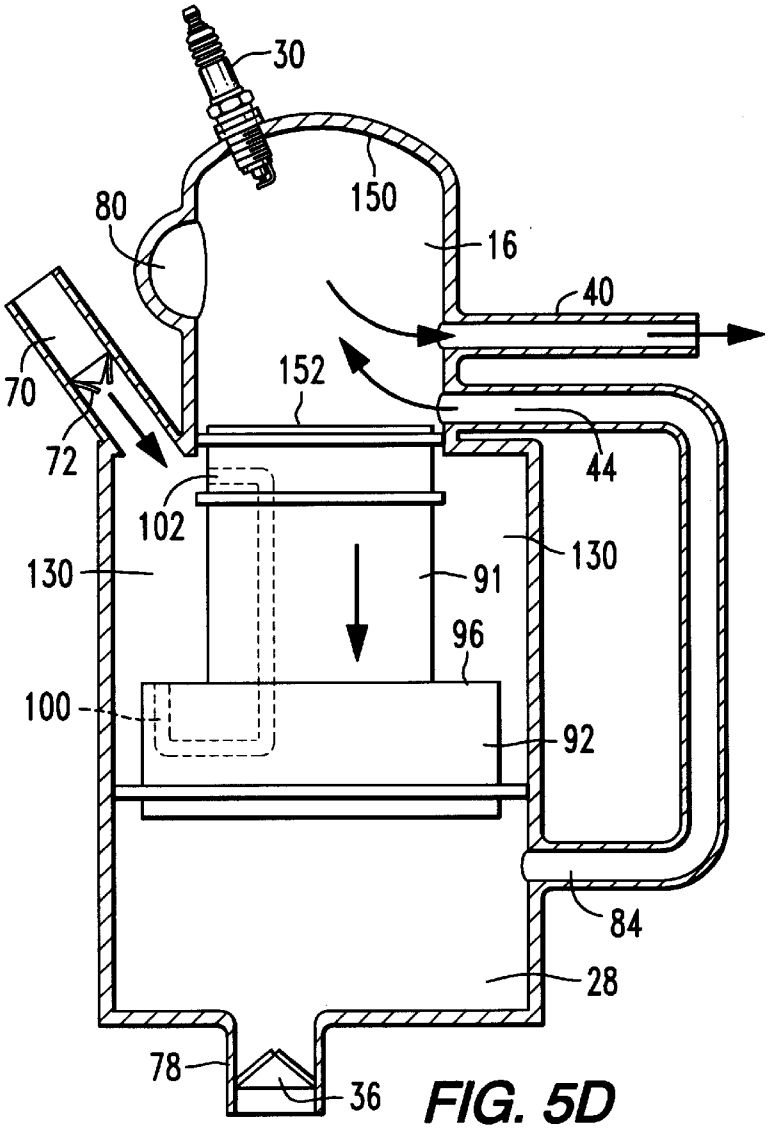
Figure 5C:
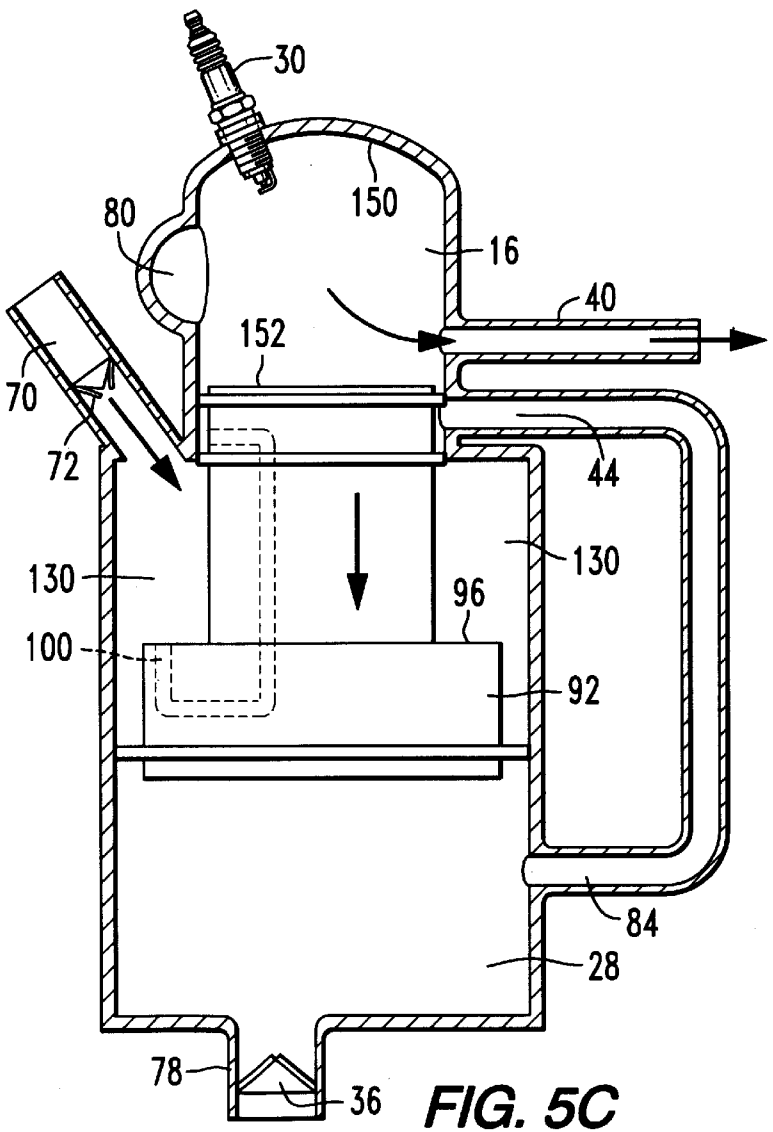

In FIG. 5C, the piston has moved downward sufficiently to expose the exhaust port 40. This allows the burned or burning fuel/air mixture to leave the combustion chamber 16 and pass through the exhaust port 40 to the atmosphere. It should be noted that the cylinder inlet port 44 is not yet exposed by the piston. In FIG. 5C, the end of the cylinder is identified by reference numeral 150 and the top of the piston is identified by reference numeral 152. The combustion chamber 16 is defined as the space between the end 150 of the cylinder and the top 152 of the piston. The gas is shown, by the arrow, flowing out of the combustion chamber 16 and through the exhaust port 40. The fuel/air mixture is shown flowing through the reed valve 72 into the compression chamber 130 and reed valve 36 is shown as blocking flow out of the crankcase 28. The pressure within the crankcase 28 continues to increase because of the continued further movement of the piston downward. This downward movement of the piston decreases the volume of the crankcase 28 and thereby raises its pressure.

In FIG. 5D, the piston is shown at its downward extreme of travel. At this point of its travel, the top 152 of the piston has exposed the cylinder inlet port 44. This allows the high pressure gas within the crankcase 28 to pass through the second conduit 84 and the cylinder inlet port 44 into the combustion chamber 16. It should be noted that the exhaust port 40 remains open and exhaust gases continue to flow from the combustion chamber 16 into the exhaust port 40. It should be understood that, although the cylinder inlet port 44 and the exhaust port 40 are shown at the same side of the cylinder in FIG. 5D, a typical application would place the port at opposite sides of the cylinder. For purposes of illustrating the basic concepts of the present invention, which are not limited by the specific locations of the exhaust port and cylinder inlet port, these two devices are shown on a common side of the figure.

With the continued reference to FIG. 5D, reed valve 72 remains open, but will be closed as soon as the piston begins to move upward from its bottom dead center position. The fuel/air mixture within the compression chamber 130 will then be trapped between the cylinder step and the piston step within the angular shape defined between the outer cylindrical surface of the first portion 91 of the piston and the inner cylindrical surface of the second portion of the cylinder.

Figure 5F:
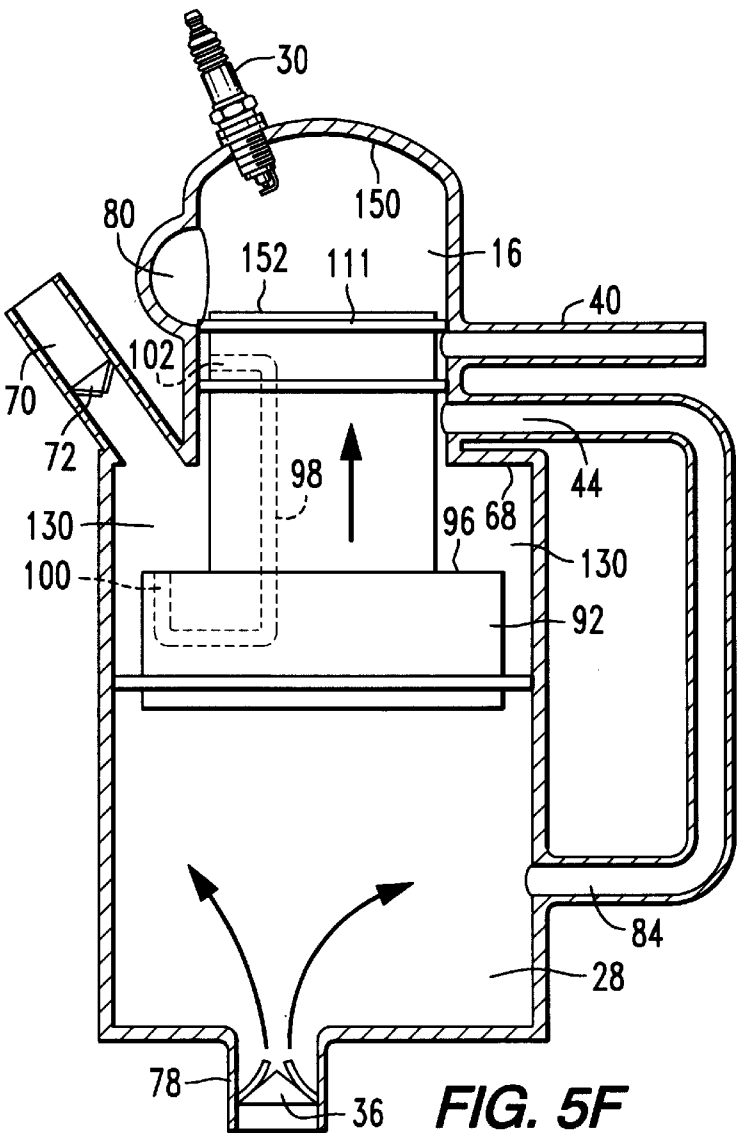
Figure 5E:
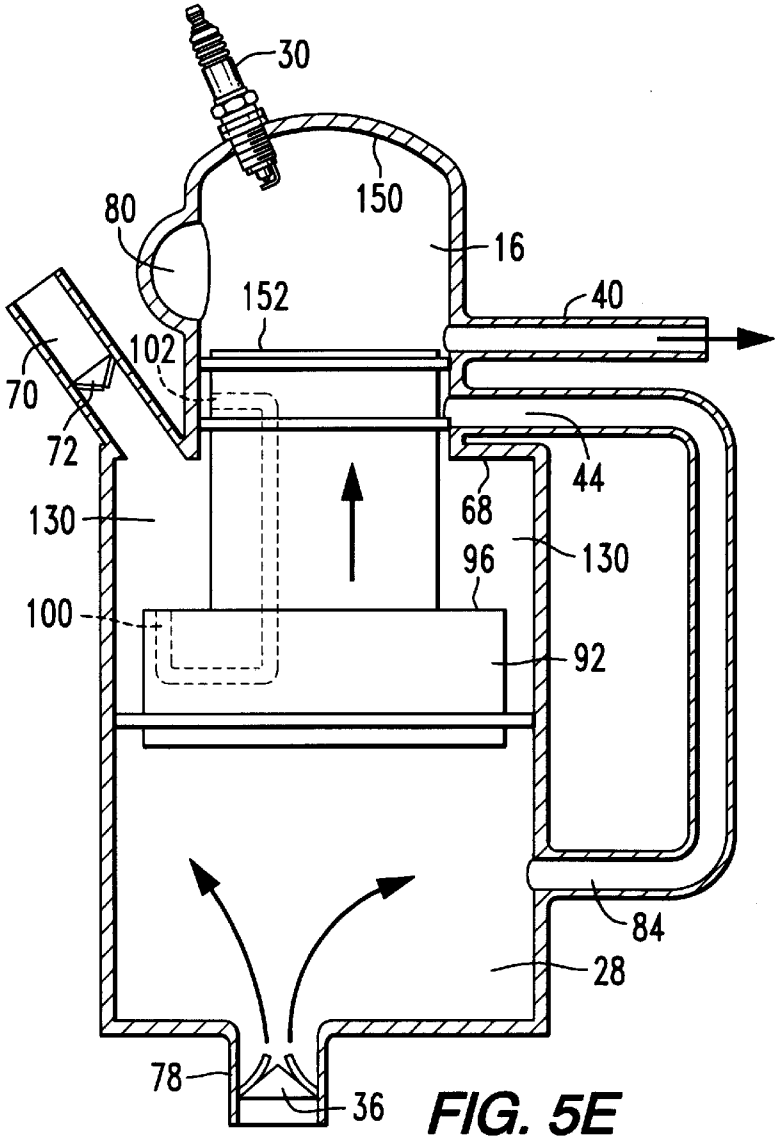

In FIG. 5E, the piston has begun to travel upward within the cylinder. The cylinder inlet port 44 is now closed by the piston, but the exhaust port 40 remains open. The upward movement of the piston causes reed valve 36 to open and permit air to flow through the intake conduit 78 into the crankcase 28. The crankcase 28 will continue to fill with air passing through the reed valve 36 as long as the cylinder inlet port 44 remains closed by the location of the piston. The fuel/air mixture within the compression chamber 130 is being pressurized by the upward movement by the piston step 96 toward the cylinder step 68. Reed valve 72 is closed to prevent passage of the fuel/air mixture away from the compression chamber 130 through the first conduit 70.

FIG. 5F shows the position of the piston as it moves past the exhaust port 40 to close it. Reed valve 36 remains open and air continues to flow into the crankcase 28 through the intake conduit 78. The fuel/air mixture within the compression chamber 130 continues to be compressed and its pressure continues to rise as the volume defined between the cylinder step 68 and the piston step 96 continues to decrease. It should be noted that in FIG. 5F, the exhaust port 40 is closed, but the upper piston ring 111 has not yet exposed the second end 102 of the transfer passage 98 to the transfer port 80. Therefore, the pressure within the compression chamber 130 continues to rise in response to the upper movement of the piston.

Figure 5H:
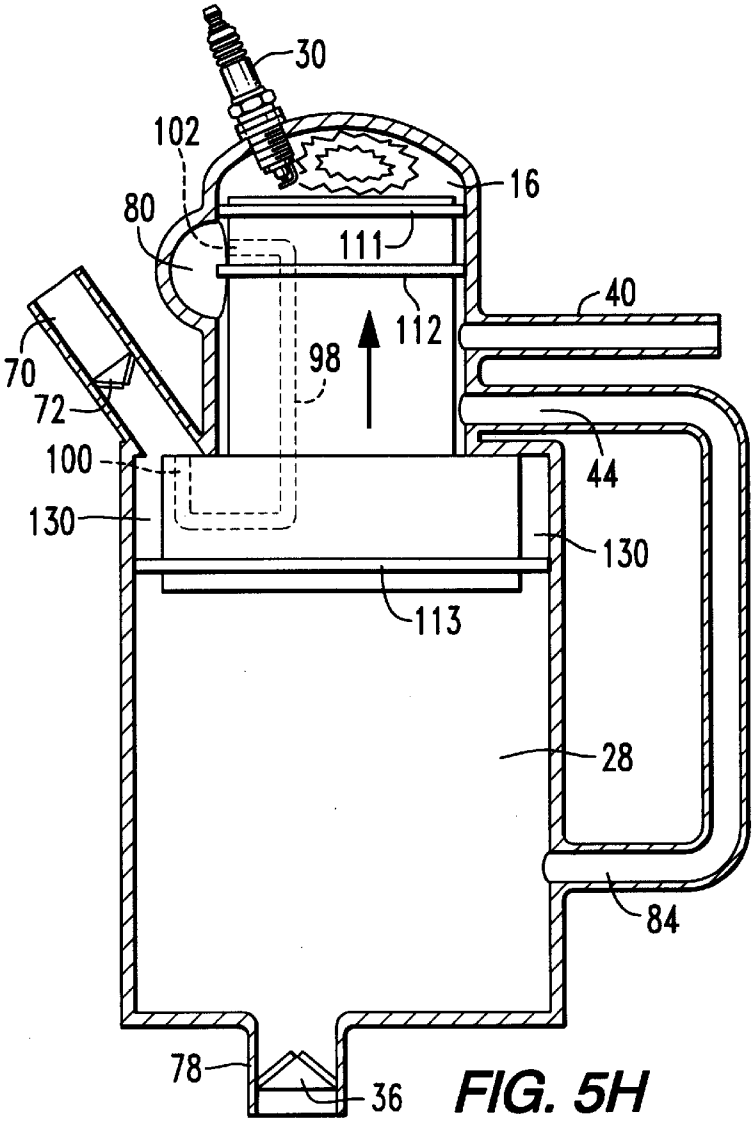
Figure 5G:
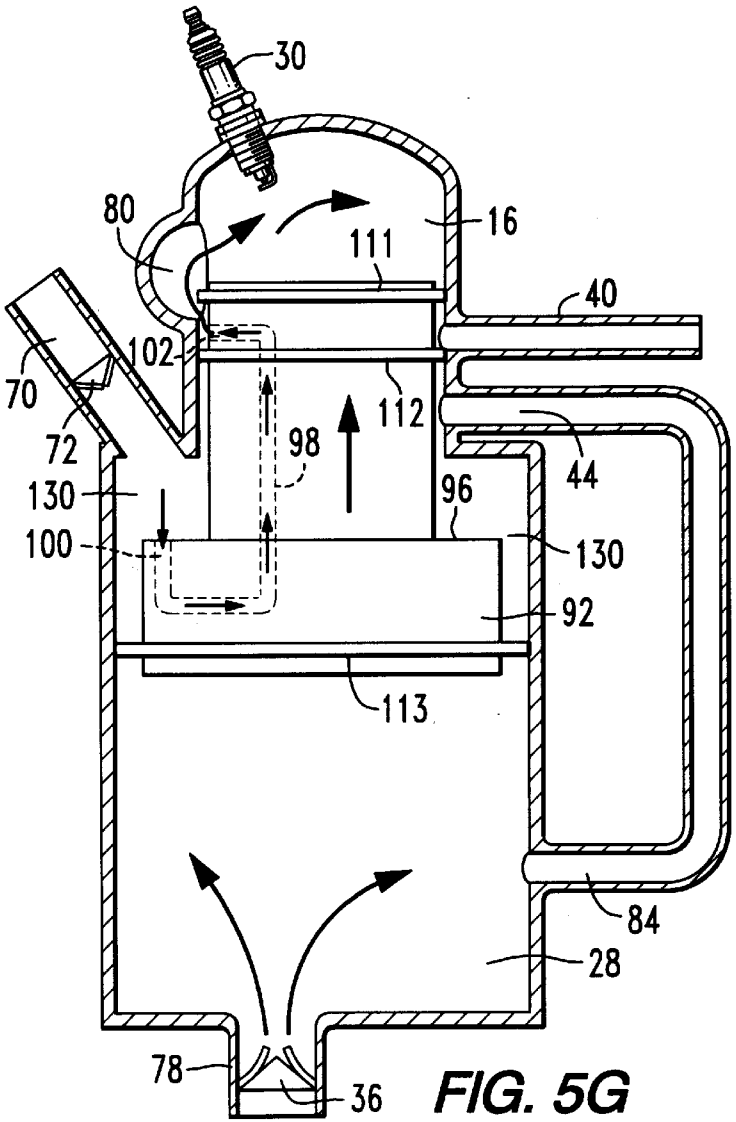

FIG. 5G shows the present invention as the upper piston ring 111 allows fluid communication between the second end 102 of the transfer passage 98 and the transfer port 80. When the piston is in the position shown in FIG. 5G, air continues to flow through reed valve 36 to fill the crankcase 28, but the air is not permitted to flow through the second conduit 84 because the cylinder inlet port 44 is blocked by the piston. In FIG. 5G, it can be seen that the fuel/air mixture trapped in the compression chamber 130 can now flow from the compression chamber into the first end of the transfer passage 98 and toward the second end 102. From the opening in the piston wall, where the second end 102 is located, the fuel/air mixture can leave the transfer passage 98 and enter the transfer port 80. The transfer port, in a typical application of the present invention, is a localized depression within the cylinder wall of the first portion of the cylinder. It allows the fuel/air mixture to leave the second end 102 of the transfer passage 98 and flow around the upper piston ring 111 into the combustion chamber 16. It is important to note that the exhaust port 40 is closed in FIG. 5G prior to the flow of fuel/air mixture into the combustion chamber 16. This prevents the chance of hydrocarbons escaping directly out of the exhaust port 40 prior to ignition by the sparkplug 30. As the piston continues to rise, the fuel/air mixture will flow through the transfer port 80 until it is blocked by the continued upward movement of the upper piston ring 111.

With continued reference to FIG. 5G, reed valve 72 is closed and reed valve 36 is opened. The crankcase continues to fill with air and the fuel/air mixture in the compression chamber 130, which has reached its maximum pressure magnitude because of the significant decrease in the volume of the compression chamber 130, moves rapidly through the transfer passage 98 and transfer port 80 into the combustion chamber 16.

In FIG. 5H, the piston has reached, or is reaching, its top dead center maximum upward position. The upper piston ring 111 has closed the transfer port 80 and has sealed the combustion chamber 16 from all alternative passages. The compression chamber 130, described above, has been reduced to vitually no volume. The exhaust port 40 and the cylinder inlet port 44 are closed by the location of the piston. The transfer port 80 is closed as is the transfer passage 98, with respect to the combustion chamber 16. The sparkplug 30 ignites the fuel/air mixture within the combustion chamber to begin the process of forcing the piston downward as was described above in conjunction with FIG. 5A.

With reference to FIGS. 5A–5H, it can be seen that the present invention provides a means by which a fuel/air mixture can be injected into the combustion chamber 16 under high pressure after the exhaust port 40 is closed. This eliminates the potential emission of hydrocarbons that flow directly out of the exhaust port without being burned. In addition, this is accomplished without the need for the need for expensive fuel injection systems.

Figure 6:
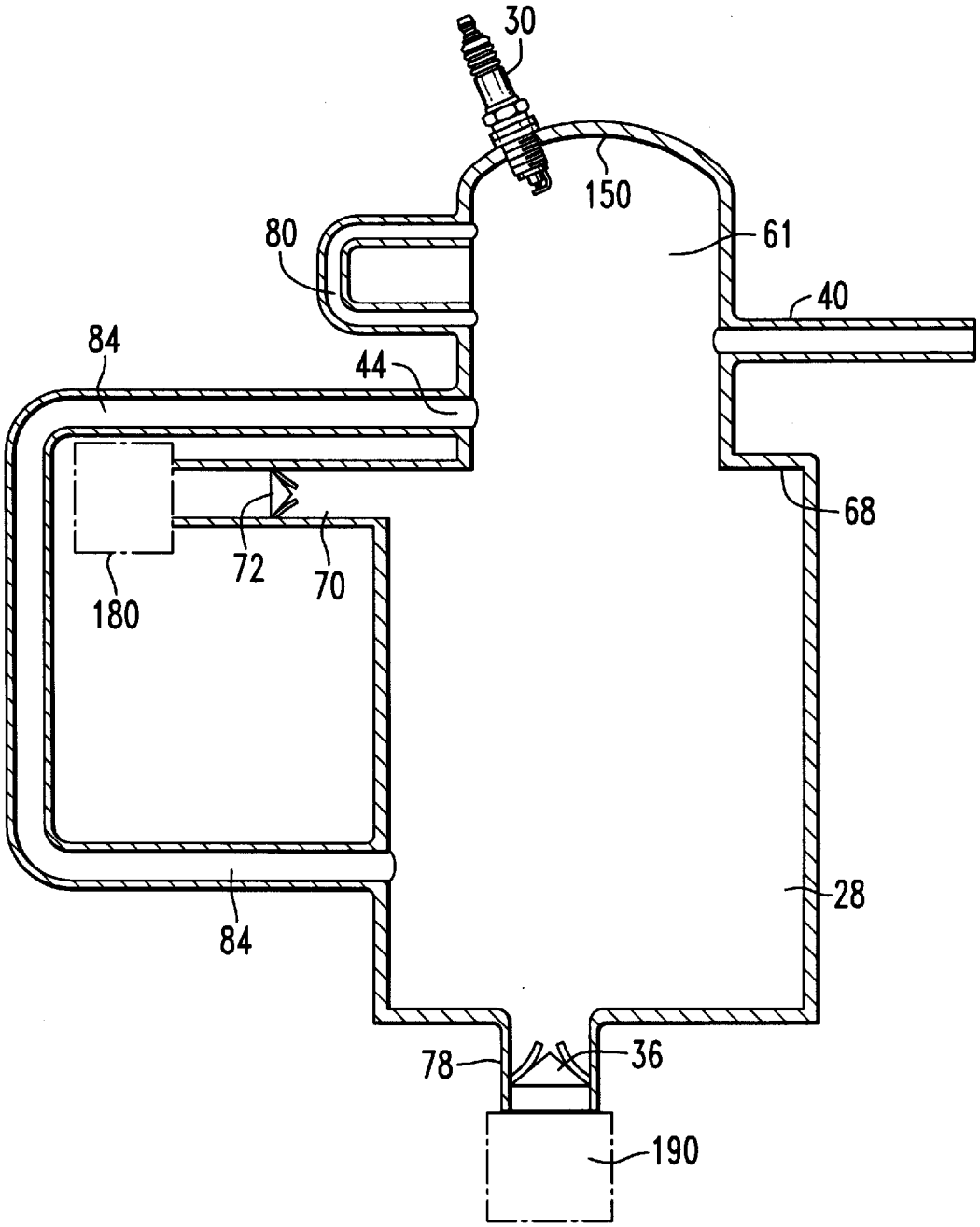
FIG. 6 shows an alternative configuration of a cylinder structure made in accordance with the present invention.

FIG. 6 shows an alternative configuration of the present invention. The purpose of FIG. 6 is to show that the specific locations of the various ports and conduits with respect to the first and second portions of the cylinder are not limiting to the present invention. In addition, FIG. 6 is intended to show the fact that the fuel supply means used to create the fuel/air mixture can either be a carburetor or a fuel injector. In addition, the intake conduit 78 can be provided with a secondary fuel supply.

In FIG. 6, the cylinder inlet port 44 is shown disposed on an opposite side of the first portion 61 of the cylinder from the exhaust port 30. This arrangement is more typical than that shown in FIGS. 5A–5H. In addition, the transfer port 80 comprises a conduit as shown in FIG. 6 rather than a simple depression formed in the wall of the first portion of the cylinder, as illustrated in FIGS. 5A–5H and described above. These various embodiments of the port and conduits are within the scope of the present invention.

Dashed box 180 represents a first fuel supply device that provides the fuel which flows into the compression chamber 130 (not shown in FIG. 6) defined between the cylinder step 68 and the piston step 96 (not shown in FIG. 6). The first fuel supply device 180 can be a carburetor or a fuel injector. The adaptation of either of these components is within the scope of knowledge of those skilled in the art of internal combustion engines.

In the above description of the intake conduit 78, it was described as being intended to allow air to flow into the crankcase 28. In known internal combustion engines, fuel is introduced into the crankcase 28 in the form of a fuel/air mixture which then passes through an air inlet, such as that identified by reference numeral 44. In a preferred embodiment of the present invention, the primary flow of the fuel/air mixture is not introduced through the intake conduit 78 but, instead, through the first conduit 70 into the compression chamber. However, it should be understood that alternative embodiments of the present invention could incorporate a secondary fuel/air system that provides a second fuel device 190 at the intake conduit 78. This second fuel supply device 190 can be a carburetor or a fuel injector. If the first and second fuel supply devices, 180 and 190, are carburetors, a typical embodiment of the device would include a two segment carburetor for these purposes. In operation, a typical application of the present invention would activate the first fuel supply device 180 during normal running, particularly at idle speed. The second fuel supply device 190 would be used at higher speeds and when the internal combustion engine experiences higher loads. When used, the second fuel supply device 190 would be a secondary fuel supply and the fuel/air mixture provided through the crankcase 28 and the cylinder inlet port 44 would be in addition to the primary fuel supply provided by the first fuel supply device 180 into the compression chamber.

Figure 7:
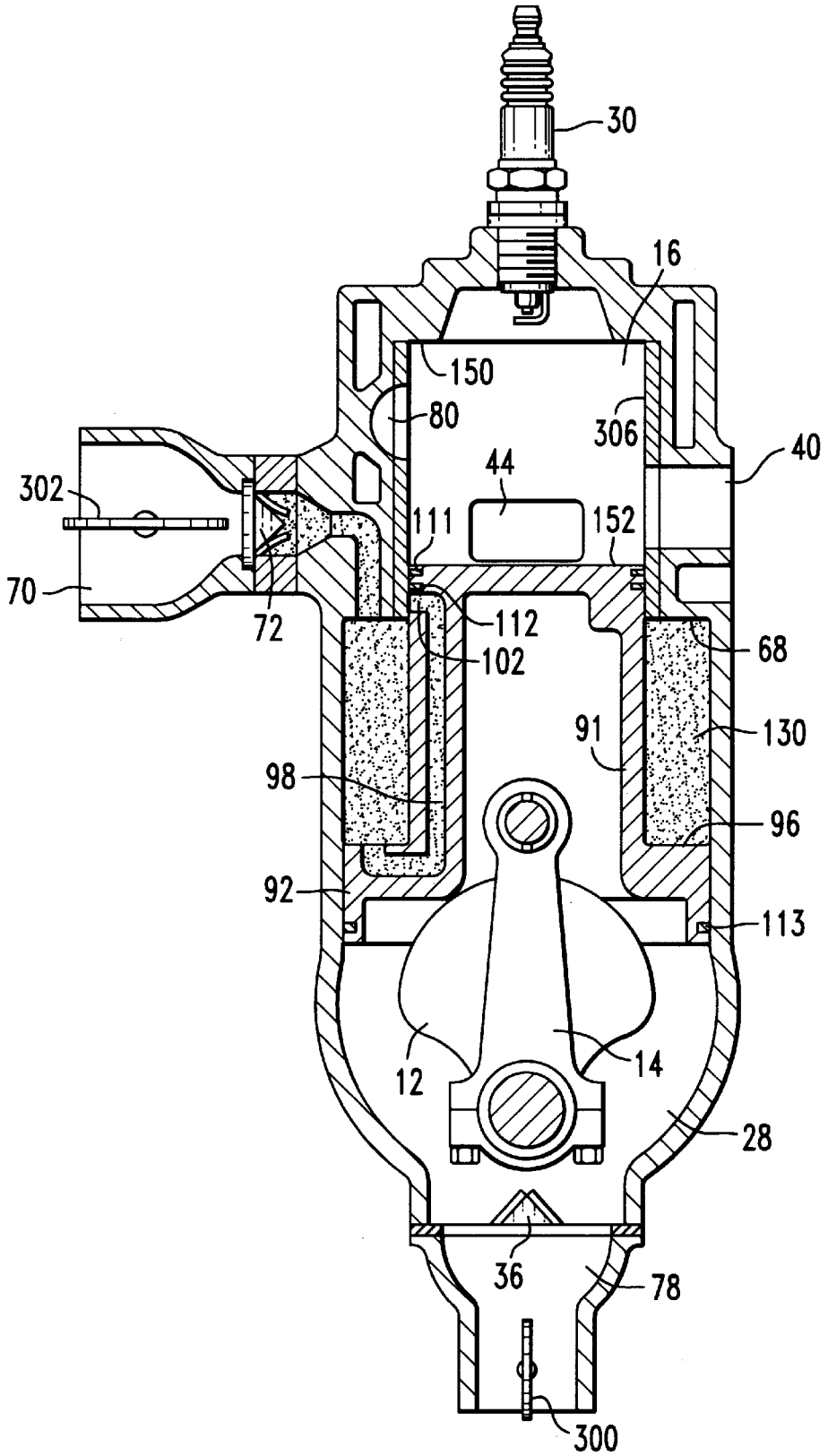
FIG. 7 shows a more detailed illustration of a cylinder and piston made in accord with the present invention.

FIG. 7 shows an embodiment of the present invention with more detail relating to the structure of the engine block and the various components described above. As shown in FIG. 7, the piston is at its bottom dead center position. The two upper pistons rings, 111 and 112, are below the exhaust port 40 and the transfer port 44. Reed valve 36 is closed and reed valve 72 is open. However, it should be understood that as the piston moves upward from its bottom dead center position, reed valve 72 will close and reed valve 36 will open. The compression chamber 130 is at its maximum volume when the piston is at the bottom dead center position. The reference numerals shown in FIG. 7 are described above in detail with respect to FIGS. 5A–5H. In addition, two rotatable plates are shown in FIG. 7. One throttle plate 300 is shown in intake passage 78 and another throttle plate 302 is shown in the first conduit 70. In addition, a liner 306 is provided in the first portion of the cylinder.

With continued reference to FIG. 7, it should be noted that in this embodiment the inlet port 44 and the exhaust port 40 are in partial axial overlapping positions. In other words, as the piston moves upward in FIG. 7, the inlet port 44 is not completely covered prior to the exhaust port 40 being partially covered.

Although described in considerable detail and illustrated with particular specificity, it should be understood that the present invention can also be used in alternative embodiments which are also within its scope.

I claim:

1. An internal combustion engine, comprising:

an engine block having a cylinder formed therein, said cylinder having a first portion and a second portion, said first portion having a first diameter which is smaller than a second diameter of said second portion, said first and second diameters of said first and second portions of said cylinder defining a cylinder step in a wall of said cylinder;

a piston having a first portion and a second portion, said first portion having a first diameter which is smaller than a second diameter of said second portion, said first and second diameters of said first and second portions of said piston defining a piston step in an outer surface of said piston, said piston being disposed within said cylinder;

a compression chamber being bounded by said cylinder and piston steps, an outer surface of said first portion of said piston and an inner surface of said second portion of said cylinder;

a combustion chamber being bounded by an end of said first portion of said cylinder, an end of said first portion of said piston and a wall of said first portion of said cylinder;

a first conduit connected in fluid communication with said compression chamber;

a transfer passage formed in said piston, said transfer passage having a first end and a second end, said first end being disposed in fluid communication with said compression chamber, said second end being disposed in fluid communication with an opening in a surface of said first portion of said piston; and a transfer port formed in a wall of said first portion of said cylinder, said transfer port providing fluid communication between said transfer passage and said combustion chamber when said opening is aligned with said transfer port.

2. The internal combustion engine of claim 1, wherein:

said first and second portions of said cylinder are disposed in coaxial relation with each other along a first axis; and said first and second portions of said piston are disposed in coaxial relation with each other along a second axis, said first and second axes being aligned with each other.

3. The internal combustion engine of claim 1, further comprising:

a first fuel supply device connected in fluid communication with said first conduit for providing a primary flow of fuel and air into said compression chamber.

4. The internal combustion engine of claim 3, wherein:

said first fuel supply device is a carburetor.

5. The internal combustion engine of claim 3, wherein:

said first fuel supply device is a fuel injector.

6. The internal combustion engine of claim 3, further comprising:

a crankcase;

a second conduit connected in fluid communication between said crankcase and said first portion of said cylinder.

7. The internal combustion engine of claim 6, further comprising:

a second fuel supply device disposed in fluid communication with said crankcase for providing a secondary flow of fuel into said crankcase and into said compression chamber through said second conduit.

8. The internal combustion engine of claim 7, wherein:

said second fuel supply device is a carburetor.

9. The internal combustion engine of claim 7, wherein:

said second fuel supply device is a fuel injector.

10. The internal combustion engine of claim 1, further comprising:

an exhaust conduit connected in fluid communication with said first portion of said cylinder.

11. The internal combustion engine of claim 6, wherein:

said exhaust conduit is connected in fluid communication with said first portion of said cylinder at a location between said end of said first portion of said cylinder and a location where said second conduit is connected in fluid communication with said first portion of said cylinder.

12. The internal combustion engine of claim 1, further comprising:

an igniter disposed at least partially within said combustion chamber.

13. An internal combustion engine, comprising:

an engine block having a cylinder formed therein, said cylinder having a first portion and a second portion, said first portion having a first diameter which is smaller that a second diameter of said second portion, said first and second diameters of said first and second portions of said cylinder defining a cylinder step in a wall of said cylinder;

a piston having a first portion and a second portion, said first portion having a first diameter which is smaller that a second diameter of said second portion, said first and second diameters of said first and second portions of said piston defining a piston step in an outer surface of said piston, said piston being disposed within said cylinder, said first and second portions of said cylinder being disposed in coaxial relation with each other along a first axis, said first and second portions of said piston being disposed in coaxial relation with each other along a second axis, said first and second axes being aligned with each other;

a compression chamber being bounded by said cylinder and piston steps, an outer surface of said first portion of said piston and an inner surface of said second portion of said cylinder;

a combustion chamber being bounded by an end of said first portion of said cylinder, an end of said first portion of said piston and a wall of said first portion of said cylinder;

a first conduit connected in fluid communication with said compression chamber;

a transfer passage formed in said piston, said transfer passage having a first end and a second end, said first end being disposed in fluid communication with said compression chamber, said second end being disposed in fluid communication with an opening in a surface of said first portion of said piston; and a transfer port formed in a wall of said first portion of said cylinder, said transfer port providing fluid communication between said transfer passage and said combustion chamber when said opening is aligned with said transfer port.

14. The internal combustion engine of claim 13, further comprising:

a first fuel supply device connected in fluid communication with said first conduit for providing a primary flow of fuel and air into said compression chamber.

15. The internal combustion engine of claim 14, further comprising:

a crankcase;

a second conduit connected in fluid communication between said crankcase and said first portion of said cylinder.

16. The internal combustion engine of claim 15, further comprising:

a second fuel supply device disposed in fluid communication with said crankcase for providing a secondary flow of fuel into said crankcase and into said compression chamber through said second conduit.

17. The internal combustion engine of claim 13, further comprising:

an exhaust conduit connected in fluid communication with said first portion of said cylinder.

18. An internal combustion engine, comprising:

an engine block having a cylinder formed therein, said cylinder having a first portion and a second portion, said first portion having a first diameter which is smaller that a second diameter of said second portion, said first and second diameters of said first and second portions of said cylinder defining a cylinder step in a wall of said cylinder;

a piston having a first portion and a second portion, said first portion having a first diameter which is smaller that a second diameter of said second portion, said first and second diameters of said first and second portions of said piston defining a piston step in an outer surface of said piston, said piston being disposed within said cylinder, said first and second portions of said cylinder being disposed in coaxial relation with each other along a first axis, said first and second portions of said piston being disposed in coaxial relation with each other along a second axis, said first and second axes being aligned with each other;

a compression chamber being bounded by said cylinder and piston steps, an outer surface of said first portion of said piston and an inner surface of said second portion of said cylinder;

a combustion chamber being bounded by an end of said first portion of said cylinder, an end of said first portion of said piston and a wall of said first portion of said cylinder;

a first conduit connected in fluid communication with said compression chamber;

a transfer passage formed in said piston, said transfer passage having a first end and a second end, said first end being disposed in fluid communication with said compression chamber, said second end being disposed in fluid communication with an opening in a surface of said first portion of said piston;

a transfer port formed in a wall of said first portion of said cylinder, said transfer port providing fluid communication between said transfer passage and said combustion chamber when said opening is aligned with said transfer port;

a first fuel supply device connected in fluid communication with said first conduit for providing a primary flow of fuel and air into said compression chamber;

a crankcase; and a second conduit connected in fluid communication between said crankcase and said first portion of said cylinder.

19. The internal combustion engine of claim 18, further comprising:

a second fuel supply device disposed in fluid communication with said crankcase for providing a secondary flow of fuel into said crankcase and into said compression chamber through said second conduit.

20. The internal combustion engine of claim 18, farther comprising:

an exhaust conduit connected in fluid communication with said first portion of said cylinder.

* * * * *